US006697027B2

(12) United States Patent
Mahon

(10) Patent No.: US 6,697,027 B2
(45) Date of Patent: Feb. 24, 2004

(54) HIGH GAIN, LOW SIDE LOBE DUAL REFLECTOR MICROWAVE ANTENNA

(76) Inventor: John P. Mahon, 338 Avenida de Royale, Thousand Oaks, CA (US) 91362

( * ) Notice: Subject to any disclaimer, the term of this patent is extended or adjusted under 35 U.S.C. 154(b) by 0 days.

(21) Appl. No.: 10/227,214

(22) Filed: Aug. 23, 2002

(65) Prior Publication Data

US 2003/0038753 A1 Feb. 27, 2003

Related U.S. Application Data

(60) Provisional application No. 60/314,534, filed on Aug. 23, 2001.

(51) Int. Cl.[7] ..... H01Q 13/00

(52) U.S. Cl. ..... 343/781 CA; 343/781 P; 343/840

(58) Field of Search ..... 343/781 CA, 781 P, 343/781 R, 782, 840, 786, 785; H01Q 13/00

(56) References Cited

U.S. PATENT DOCUMENTS 4,963,878 A 10/1990 Kildal
5,959,590 A 9/1999 Sanford et al.
5,973,652 A * 10/1999 Sanford et al. ..... 343/781 P
6,107,973 A * 8/2000 Knop et al. ..... 343/781 P
6,137,449 A 10/2000 Kildal

* cited by examiner

*Primary Examiner*—Hoanganh Le
(74) *Attorney, Agent, or Firm*—Robert J. Schaap

(57) ABSTRACT

A significant problem in rotationally symmetric dual reflector systems is the blockage caused by the sub-reflector. This blockage produces lower gain and higher side lobes. The invention disclosed herein can be used to minimize or eliminate the blockage effects. In its simplest form, the invention is to place a hole in the sub-reflector. This allows radiation to by-pass the main reflector and replaces the radiation which is blocked by the sub-reflector. In general this radiation and the radiation which progresses on the standard path, which includes the main reflector, will not be in a useful phase and amplitude relationship. However by appropriate design of the inner and outer sub-reflector surfaces, the main reflector surface, the feed aperture, the dielectric support and the possible use of a dielectric rod, the phase and amplitude relationships can be controlled. The invention also applies to cylindrical dual reflector systems which are symmetric about a plane.

8 Claims, 7 Drawing Sheets

HIGH GAIN, LOW SIDE LOBE DUAL REFLECTOR MICROWAVE ANTENNA

RELATED APPLICATION

This application is based on derives the benefit of our U.S. Provisional Patent Application Serial No. 60/314,534 filed Aug. 23, 2001, for High Gain, Low Side Lobe Dual Reflector System Which Minimizes Sub-Reflector Blockage.

BACKGROUND OF THE INVENTION

1. Field of the Invention

The invention consists of improvements to rotationally symmetric dual reflector systems and symmetric cylindrical dual reflector systems. These antennas are used for the transmission and/or reception of electromagnetic waves. The antennas are used in many applications which include point to point links, telemetry and satellite communication.

2. Brief Description of Related Art

Dual reflector systems are commonly used in communication systems. They generally comprise a main reflector usually based on a parabolic shape and a sub-reflector, usually based on a hyperbolic or elliptical shape, and a feed. The systems with sub-reflectors using hyperbolic shapes are referred to as Cassegrain systems while the ones using elliptical shapes are referred to as Gregorian systems. In the transmitting mode, a feed is used to radiate energy towards the sub-reflector. The energy bounces off the sub-reflector towards the main reflector and then bounces again off this main reflector. In a receiving mode, the energy follows the reverse path.

Generally the description above and all of the description below apply to cylindrical geometries (where the cross-section of the geometry remains essentially constant) or rotationally symmetric geometries where each reflector is a surface of revolution. In both of these types there are many variations where the actual reflector shapes are cut from cylindrical or rotationally symmetric shapes. For example, it is common to base the reflector shapes on a portion of rotationally symmetric shapes so that the actual reflector has an elliptical rather than circular projection. In systems which are large in relation to the wavelength of the transmitted or received radiation, the reflector systems and shapes of the reflectors can be designed with the use of optical techniques.

When the dual reflector system is reduced in size, the sub-reflector may become small in relation to the wavelength of the received/transmitted radiation. Also, it is common to support the sub-reflector by attaching it to the feed via a dielectric support structure. Commonly, this is a tube or a rod or a partial cone. In this case the optical techniques used for the design of the bigger systems do not work very well. For the small reflectors more elaborate techniques which account for the near field effects of the sub-reflector, the support and the feed are used.

Common methods of analysis of such antenna systems are the Method of Moments and FDTD (Finite Difference Time Domain). It has been found by many authors that sub-reflector shapes other than those based on hyperbolas and ellipses work well. Furthermore, in early designs, the sub-reflectors were simple metallic plates and the sub-reflector-feed combinations were called "splash plate" feeds. One of the major attractions of the geometries described above is the location of the feed. It protrudes through a hole in the main reflector and is attached to the main reflector near its vertex. This allows the shortest possible paths from the transmitter and/or receiver which are usually housed behind the main reflector.

The major problem with the geometries described above is the blockage caused by the sub-reflector or sub-reflector-feed combination. This blockage can be easily seen when the antenna is operating as a receiver. The blockage mechanism is crudely described by the following: The radiation that hits the sub-reflector is reflected by it and does not reach the main reflector. However, the radiation that reaches the main reflector is reflected towards the sub-reflector which bounces it into the feed. Generally the blockage causes two undesirable effects to the antenna radiation pattern. The first is a reduction in the antenna's on-axis gain and the second is an increase in the level of the side lobes. In particular, the side lobes close to the main beam (inner side lobes) can be greatly increased by the blockage.

Although the invention can be used for large antenna systems with small frequency bandwidths, it will be particularly useful in smaller antenna systems such as those which previously used "splash plate" feeds. Many workers have studied these reflector systems. In particular, the invention can replace those described in U.S. Pat. Nos. 4,963,878, 6,020,859 and 5,959,590. The first two of these patents describe an evolution of inventions by Kildal. The third patent by Sanford et al. is an improvement on earlier inventions by Kildal. These patents describe various shaped sub-reflectors and main reflectors.

The intention of these above-described inventions is to improve the far-field pattern performance of the antenna system. These inventions improve the gain and far out side lobes of the antenna patterns. They also allow operation of the antenna in a dual polarization mode. U.S. Pat. No. 6,137,449, also by Kildal, describes a number of ways of improving the mechanical design of the antenna plus a method for producing a dual band antenna.

SUMMARY OF THE INVENTION

In modern antenna systems there is increasingly a requirement to produce 1) high gain antennas with 2) low inner side lobes, 3) low far side lobes and 4) low VSWR (Voltage Standing Wave Ratio). With this invention it is possible to produce a better compromise between all four requirements than could be done previously.

The invention described here differs greatly from earlier inventions U.S. Pat. Nos. 4,963,878, 6,020,859 and 6,137,449 by Kildal since these do not address the problem of blockage of the feed and do not place a hole in the sub-reflector. The invention in U.S. Pat. No. 5,959,590 by Sanford et al. partially addresses the blockage problem by producing a small sub-reflector but does not include a hole in the sub-reflector.

Other important differences between the prior art and the present invention is the use of a more elaborate feed aperture and a simpler dielectric support. In the inventions by Kildal and Sanford et al, a simple tube is used as a feed but an elaborate dielectric plug is typically used to support the sub-reflector. In this present invention one or more chokes on the feed aperture help to control the radiation from the feed. Typically the feed aperture will be approximately as large as the sub-reflector. This larger diameter feed aperture produces more control of the radiation from the feed-sub-reflector combination and allows more freedom in the design of the dielectric support. Another benefit is improved control of the VSWR (voltage standing wave ratio) measured in the feed.

Due to the complexity of the interactions between the antenna components, it is not possible to produce closed form formulae for their dimensions. Rather, the goal of the invention is to establish a general geometry from which specific designs can be found which meet the desired requirements for particular applications. The detailed dimensions of the components can only be found by utilizing a computer optimizer which controls an accurate computer analysis program. Nowadays, there are a number of software packages available with these capabilities.

The invention allows the minimization or elimination of the sub-reflector blockage effects. In its simplest form, the invention is the inclusion of a hole or opening in the sub-reflector. This allows some energy to travel directly to or from the feed sub-reflector combination and by-pass the main reflector. In general the radiation that passes through the hole will not be in phase with the radiation which travels via the path that includes the main reflector. Usually, the latter path is much longer. This is where careful design of the reflector system is required.

By appropriate design of all the components in the antenna system, it is possible to force the two paths to be different by approximately an integer number of wavelengths and therefore force the two signals to be in phase. The number of wavelengths difference in the path lengths determines the frequency bandwidth over which the hole produces an improved antenna pattern. Increases to the difference in path length decrease the frequency bandwidth. A larger bandwidth can be achieved by implementation of a device which slows the radiation which passes through the hole. One such device is a dielectric rod for rotationally symmetric geometries or a dielectric slab for cylindrical geometries.

The invention applies equally well to antennas based on rotationally symmetric components or on cylindrical components. There are a number of components and surfaces that can be used to control the relative amplitude and phase of the radiation through the hole and the radiation which bounces off the main reflector. These are the inner surface of the sub-reflector (the surface which faces the feed and main reflector), the outer surface of the sub-reflector which faces away from the main reflector and feed, the main reflector, the feed aperture and the dielectric piece which supports the sub-reflector. There are eight components to the antenna system. The first five are essential to the invention. The others may exist depending on the antenna requirements.

A main reflector.

A shaped feed aperture.

A shaped outer surface of the sub-reflector.

A shaped inner surface of the sub-reflector.

A hole or opening in the sub-reflector.

A device which supports the sub-reflector.

A device used to slow the hole radiation e.g. a dielectric rod or slab.

A radome.

The structure of feed sub-reflector combinations in rotationally symmetric antenna systems naturally produces a ring focus rather than a point focus. Thus, in the preferred embodiment, the main reflector is usually based not upon a paraboloid but on a surface of revolution of a half parabola whose axis is parallel to, but offset from, the axis of revolution. This shape will be referred to as a SROP (Surface of Revolution of an Offset Parabola).

In cylindrical antenna systems, the same principle applies. The main reflector is based on a parabola whose two halves are separated by some distance. For improved pattern control, the shape of the main reflector is often perturbed from the pure parabolic shape. Improved frequency bandwidth is achieved by the reduction of the difference between the path length of the radiation which passes through the hole and that of the radiation which bounces off the main reflector. This is achieved by choosing a main reflector with a small F/D (Focal length divided by Reflector Diameter) ratio.

In cylindrical geometries, the feed usually contains a parallel plate waveguide. Depending on the separation of the plates, this guide can support one or more polarizations. For rotationally symmetric geometries, the feed usually contains a circular waveguide but in some applications a coaxial waveguide transmitting and/or receiving the $TE_{11}$ mode can be used. Around the mouth of these waveguides, one or more chokes are used to help control the radiation from the feed and the VSWR. Commonly, for the same reasons, transformer sections are also added to the waveguide.

The shape of the outer surface of the waveguide varies greatly from application to application. It is used to help control the shape of the radiation pattern of the energy that passes through the hole. In some narrow band applications, the surface may contain little or no shaping. For other applications, the surface can be shaped like a horn. The inner surface of the sub-reflector is used to control the relative amounts of radiation passing through the hole and between the feed and sub-reflector. It also helps control the VSWR seen in the feed waveguide. Like the outer surface, there are applications where the inner surface is very simple and other applications where the inner surface can resemble a stepped cone.

The size and length of the hole in the sub-reflector help control the amplitude and phase of the radiation through the hole. Usually a dielectric plug is used to reduce the size of the hole while still allowing the radiation to pass through the hole. The plug is also used for environmental reasons since it helps enclose the cavity between the feed and the sub-reflector. A convenient means of supporting the sub-reflector in rotationally symmetric antenna systems is to use a dielectric tube. The tube can be relatively thin while still producing a sturdy mechanical support for the sub-reflector. The tube is usually glued to the feed aperture and the sub-reflector.

In cylindrical systems, the supports can be integrated with the dielectric piece which fills the opening in the sub-reflector. In these geometries, the sub-reflector is actually made from two separate pieces which can be glued to the integrated dielectric piece which in turn is glued to the feed aperture. Dielectric rods and slabs are waveguiding structures which slow the wave. If one of these is used in the radiation path through the hole, the effective path difference between this radiation and the radiation which bounces off the main reflector is reduced. This results in an improved frequency bandwidth. The dielectric rod or slab can be integrated with the plug which fills the hole in the sub-reflector. This produces a sturdy mechanical arrangement. Radomes are required for most antenna systems.

There are many choices in shapes and location of the radome. Many times they are placed over the rim of the main reflector. Depending on the frequency of operation and the mechanical constraints on the radome materials and thickness, the radome can have a significant effect on the performance of the antenna. This is particularly true for the low side lobe, high frequency applications. Because of this, the effects of the radome must be included in the computer modeling of the antenna.

This invention possesses many other advantages and has other purposes which may be made more clearly apparent from a consideration of the forms in which it may be embodied. These forms are shown in the drawings forming a part of and accompanying the present specification. They will now be described in detail for purposes of illustrating the general principles of the invention. However, it is to be understood that the following detailed description and the accompanying drawings are not to be taken in a limiting sense.

BRIEF DESCRIPTION OF THE DRAWINGS

The invention will be understood fully with reference to the drawings, where.

DETAILED DESCRIPTION OF THE INVENTION

Figure 1:
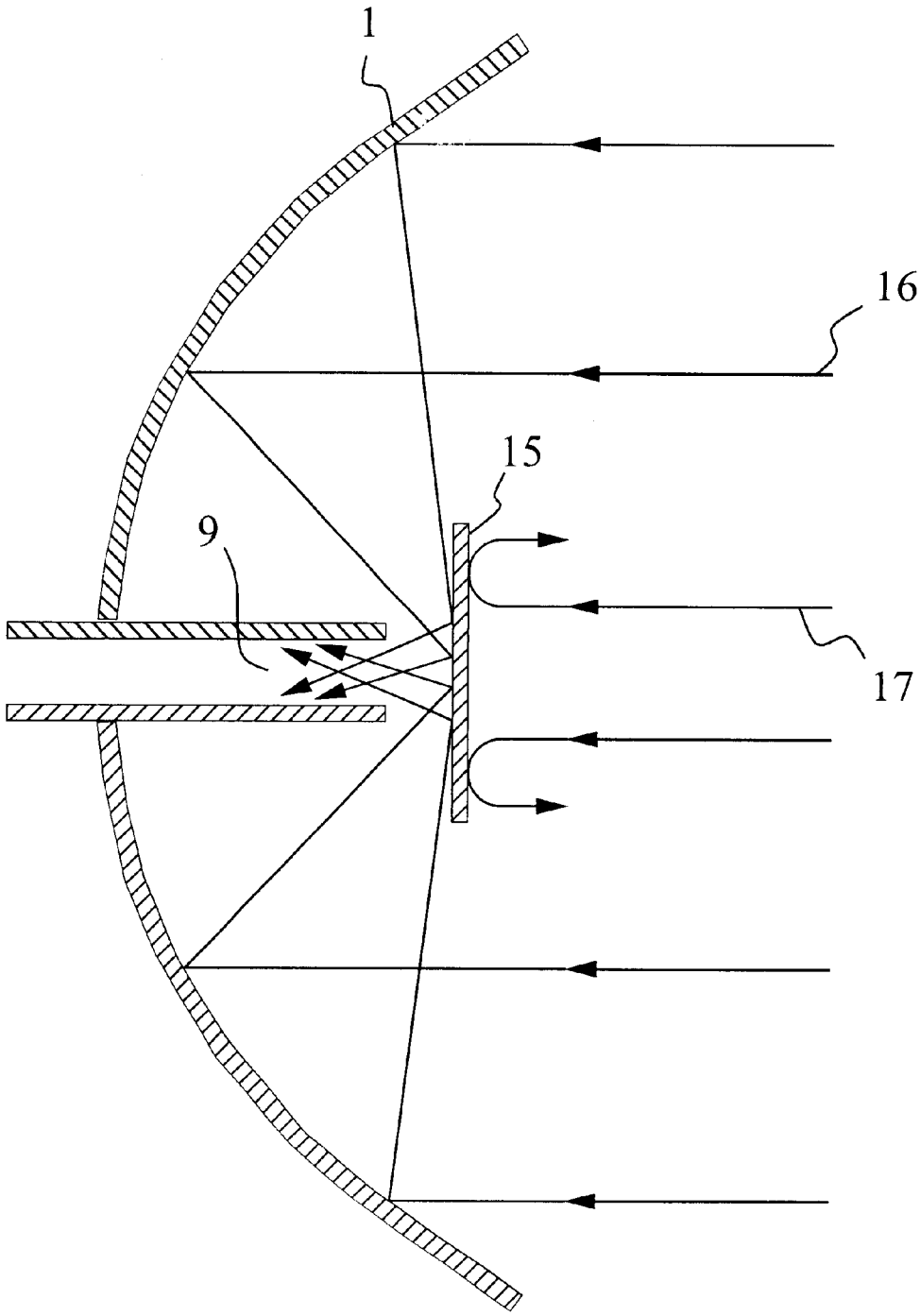
FIG. 1 is a cross-sectional drawing illustrating a prior art splash plate antenna system. This drawing shows the blockage effect of the sub-reflector.

A conventional rotationally symmetric antenna system utilizing a splash plate feed is shown in FIG. 1. It contains a main reflector 1 which is based on a parabolic shape, a circular waveguide feed 9 and a splash plate 15. The splash plate is shown as a flat plate but other shapes can be used including those suggested in U.S. Pat. Nos. 4,963,878, 6,020,859, 6,137,449 and 5,959,590. When used as a receiver of radiation parallel to the axis, most of radiation follows paths similar to those labeled 16. This radiation bounces off the main reflector and enters the feed via the gap between the feed and the splash plate. The radiation path labeled 17 shows the radiation incident onto the outer surface of the splash plate. This blocked radiation bounces off the splash plate and travels away from the antenna.

Figure 2:
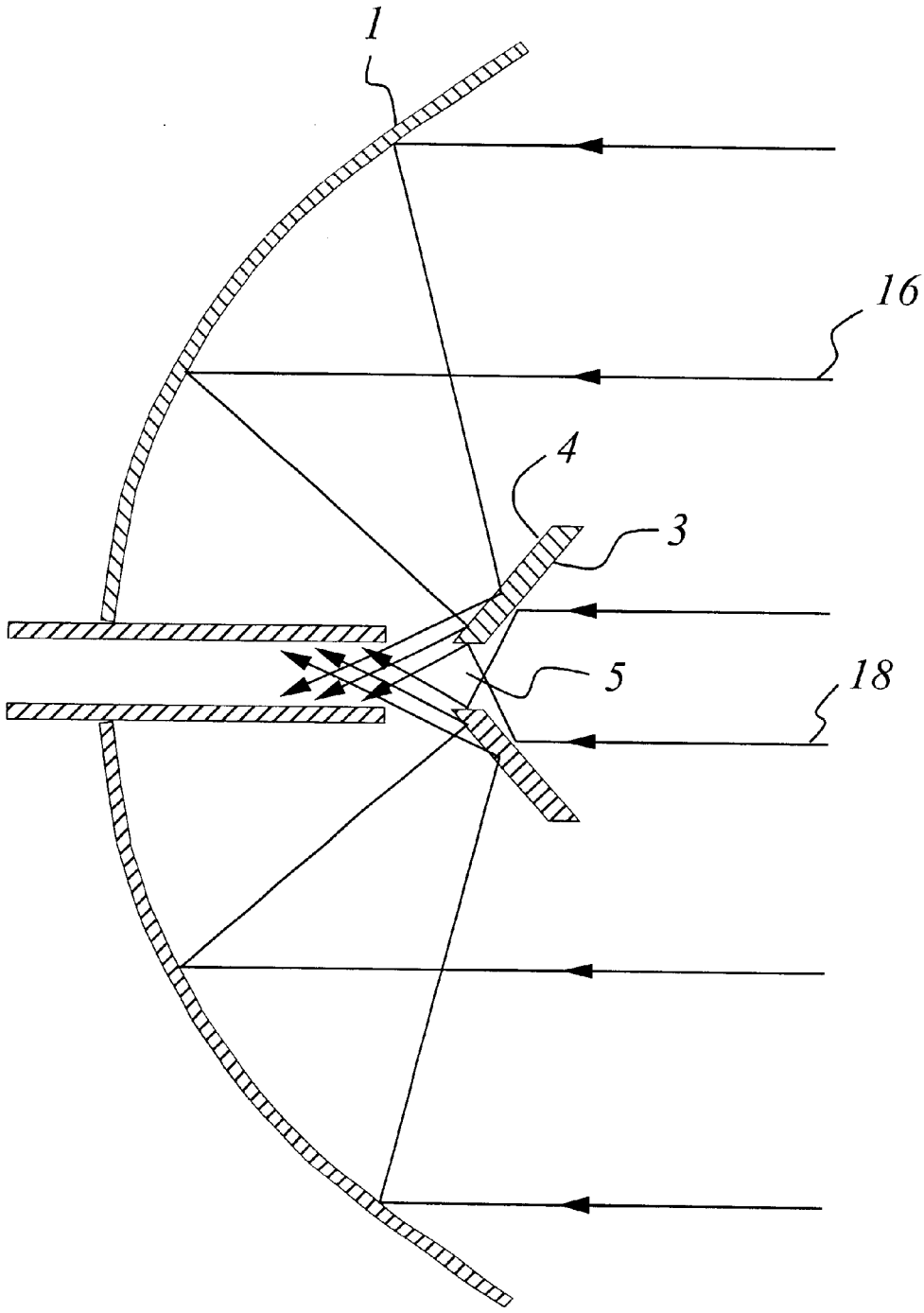
FIG. 2 is a cross-sectional drawing illustrating a representation of the invention and showing the two alternative paths for the radiation with one path bypassing the main reflector by passing through the hole or opening in the sub-reflector, while the other path includes the main reflector.

FIG. 2 illustrates the essential concept for the invention. The splash plate in FIG. 1 is replaced with a sub-reflector 3 with a hole 5 and shaped inner surface 4 and outer surface 3. The radiation 18 directly incident onto the sub-reflector passes through the sub-reflector and is collected by the feed. The path for this radiation is shorter than that for the radiation 16 that bounces off the main reflector 1. However they can be placed in phase if the path lengths are different by an integer number of wavelengths.

FIGS. 3 through 7 illustrate embodiments of the invention. In each figure the critical features of the invention have been labeled with the same reference numbers.

Figure 3:
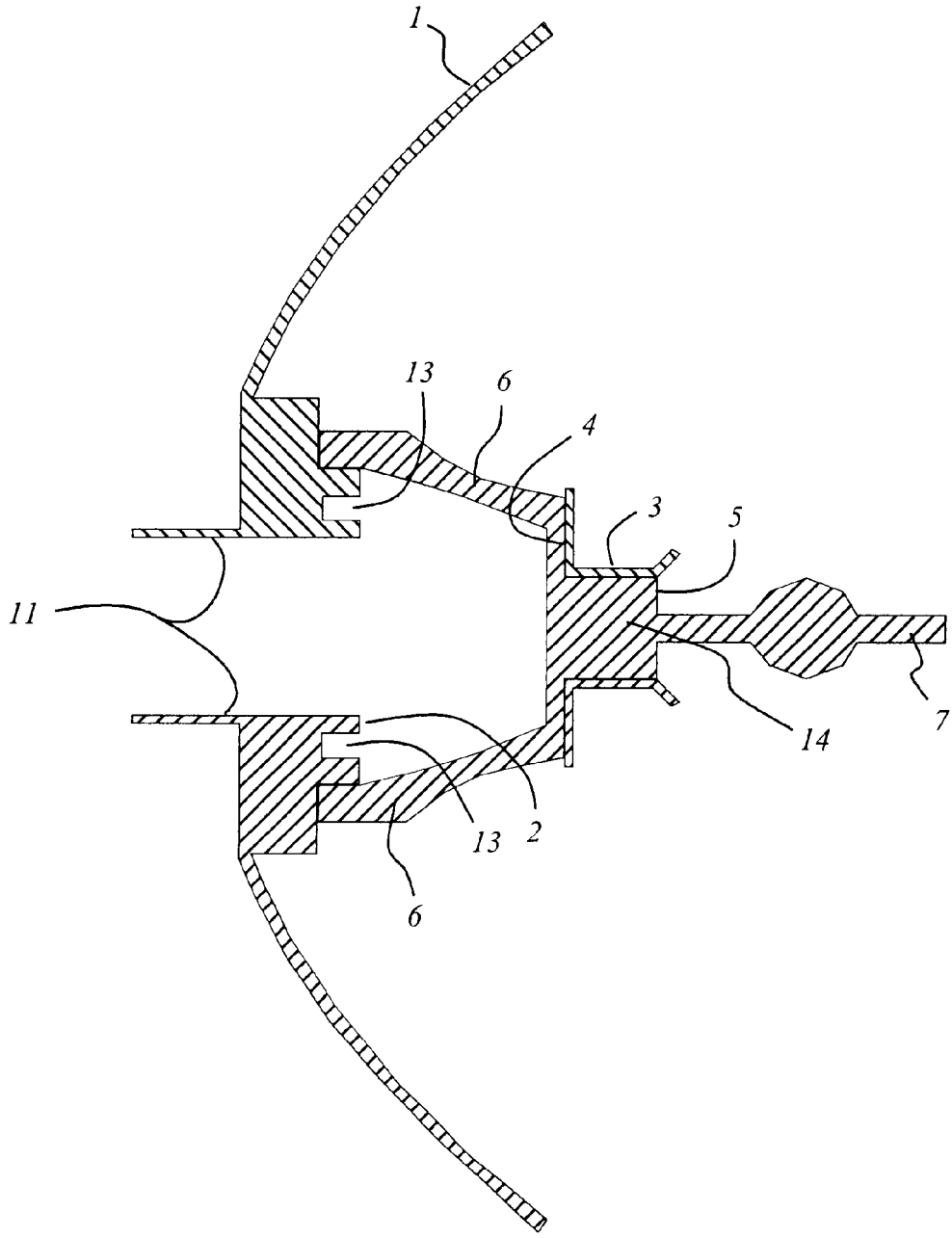
FIG. 3 is a cross-sectional drawing of a cylindrical example of an antenna system of the invention which was built for a low-profile, dual-polarized, mobile antenna application.
Figure 4:
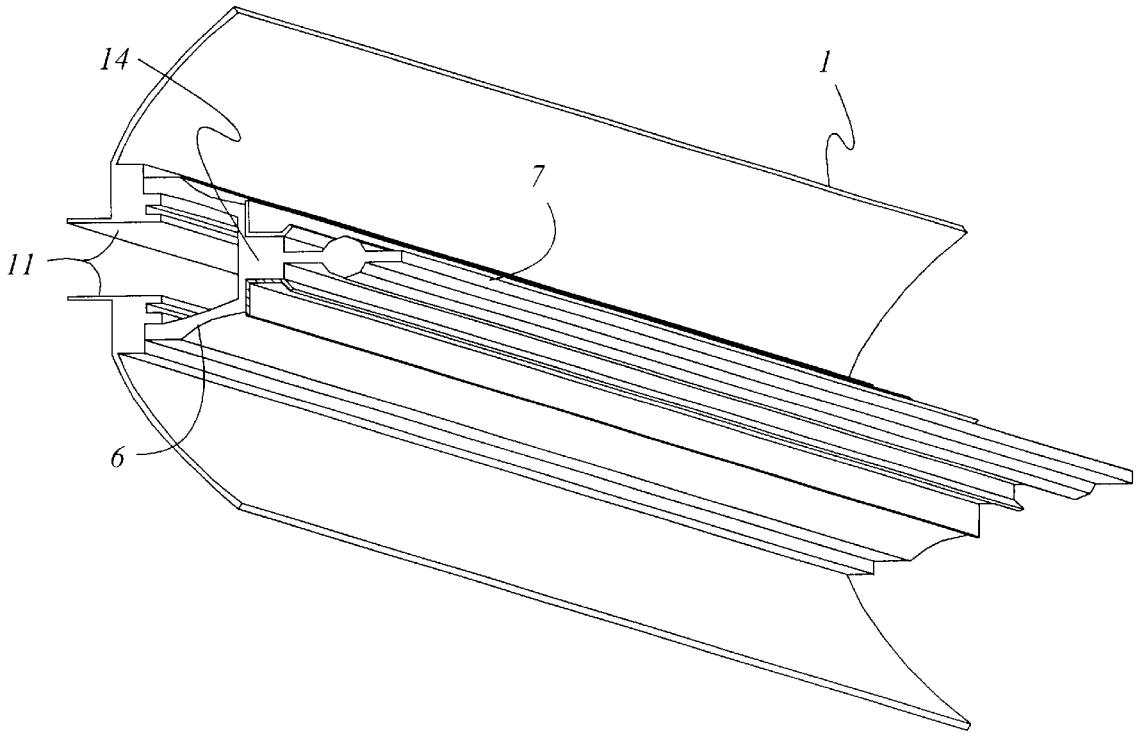
FIG. 4 is a perspective view of the cylindrical example of the invention shown in FIG. 3.

FIG. 3 and FIG. 4 illustrate a cylindrical embodiment of the invention. The antenna aperture is approximately 4.2 wavelengths wide. The total width of the sub-reflector is approximately one wavelength. This antenna is used for a dual circularly polarized mobile antenna for satellite communication and operates over a 4% frequency bandwidth. The design goal was to maximize aperture efficiency, equalize the radiation phases and equalize the aperture efficiencies of the two linear polarizations. The measured aperture efficiency is greater than 78.5%. (The predicted efficiency, which is probably more accurate, is greater than 82%). The measured axial ratio produced by the antenna was less than 1 dB. In this case the main reflector 1 has a parabolic shape. The feed waveguide is a parallel plate waveguide 11 designed to propagate dual polarized radiation. This waveguide opens into the shaped feed aperture 2 which contains chokes 13.

A polycarbonate or other non-reflective or dielectric piece fulfills many roles. Its two "legs" 6 are used to support the sub-reflector pieces and connect them to the feed aperture 2. The "legs" 6 are glued to the structure surrounding the aperture and the sub-reflector. The opening 5 between the sub-reflector pieces is filled with another section of the polycarbonate piece 14. The polycarbonate also forms a dielectric slab waveguide 7 used to slow the radiation which passes through the opening 5. In this embodiment, shaping the polycarbonate piece allows extra control of the radiation for the two polarizations. The metal sub-reflector is formed from two pieces. The inner surfaces 4 of these pieces are very simple in this case. The outer surfaces 3 produce a small horn-like shape which helps control the radiation through the hole.

Figure 5:
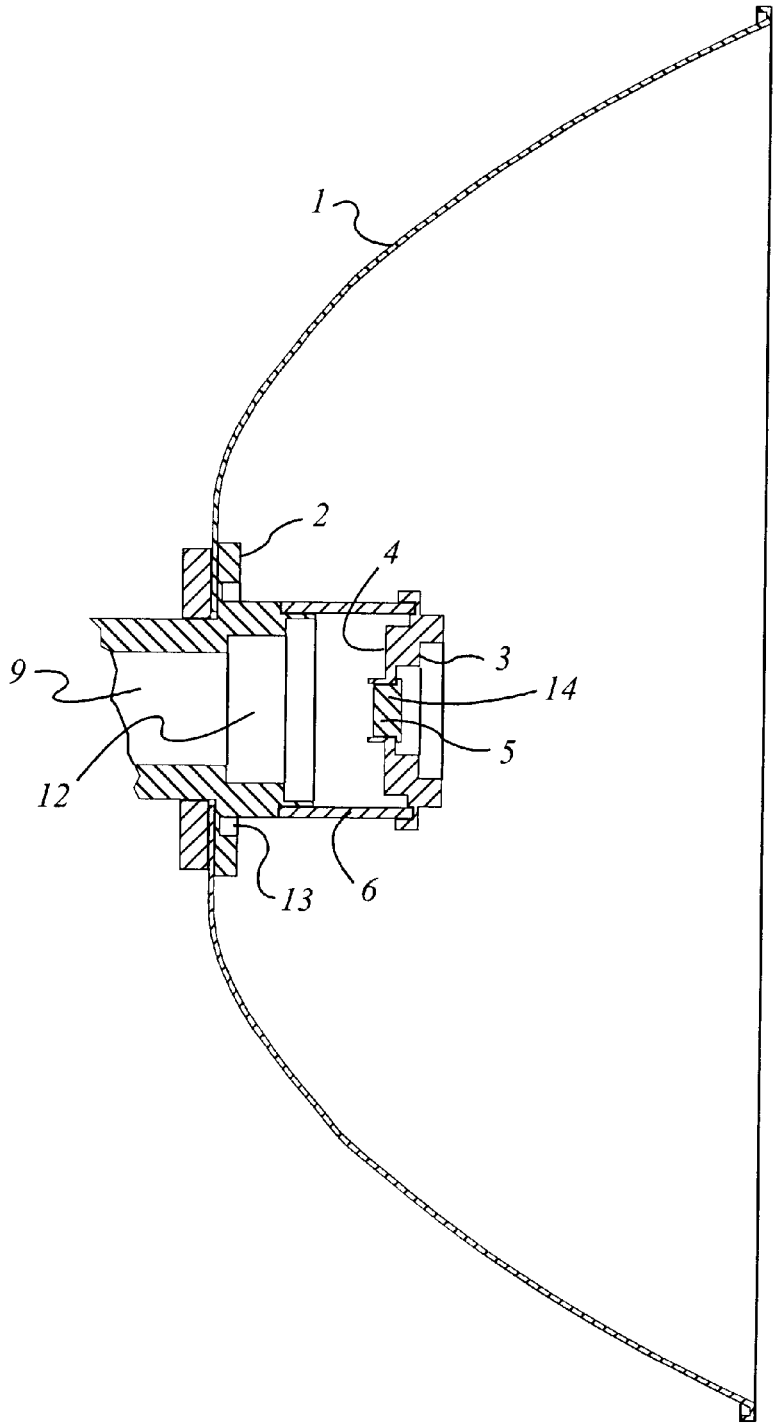
FIG. 5 is an axial cross-sectional drawing of a rotationally symmetric example of an antenna of the invention which was also built for a low-profile, dual-polarized, mobile antenna application.

FIG. 5 illustrates a rotationally symmetric embodiment of the invention. This antenna has an aperture diameter of approximately eight wavelengths. The sub-reflector diameter is approximately 1.4 wavelengths. This antenna is used for a dual polarized mobile antenna for satellite communication and operates over a 4% frequency bandwidth. The design goal was to maximize the aperture efficiency. The measured aperture efficiency is greater than 78%. (The predicted efficiency, which is probably accurate, is greater than 81.5%).

The main reflector 1 is a SROP. The feed is based on a circular waveguide 9 and contains two transformer sections 12 which help to produce a low VSWR and control the radiation pattern. The shaped feed aperture 2 contains a choke 13 and a flange 20 which is used to mechanically adhere the feed to the main reflector.

A tubular polycarbonate support 6 for the sub-reflector is glued to the feed aperture and the inner surface of the sub-reflector 4. The shaped inner surface of the sub-reflector has a number of steps which influence the relative radiation between the feed and sub-reflector and through the hole. The hole 5 in the sub-reflector is plugged by a piece of polycarbonate 14. The outer surface 3 of the sub-reflector forms a horn which helps control the radiation which passes through the hole.

Figure 6:
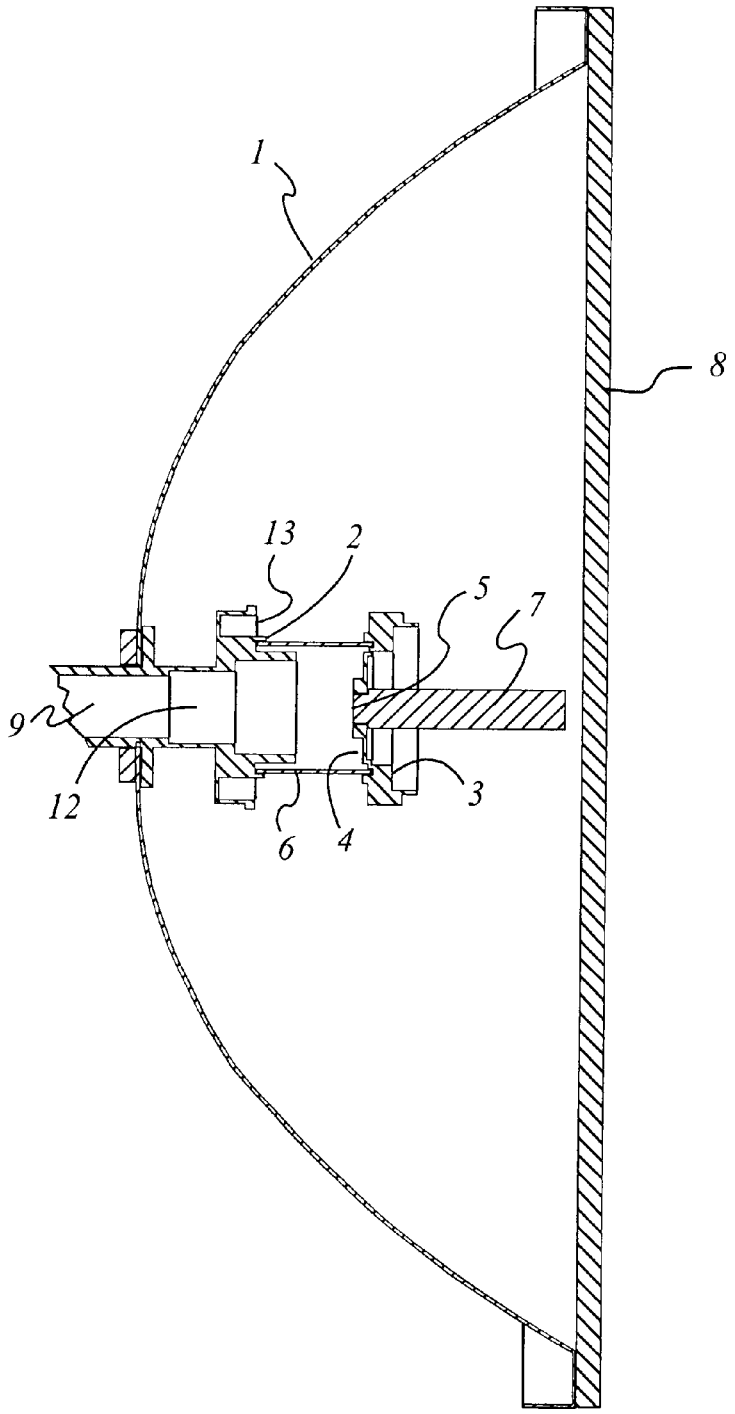
FIG. 6 is an axial cross-sectional drawing of a rotationally symmetric example of an antenna of the invention which was designed for point to point communications.

FIG. 6 illustrates a rotationally symmetric embodiment of the invention. This antenna has an aperture diameter of approximately thirteen wavelengths. The sub-reflector diameter is approximately two wavelengths. It is designed for point to point communications and operates over a 4.7% frequency bandwidth. The requirements for this antenna were high gain and strict control of the near and far side lobes. The predicted gain for this antenna is greater than 30.7 dBi. This antenna has all the features of the antenna in FIG. 5 with some extra features. Although the main reflector 1 is based on a SROP, it does not have a pure parabolic shape.

The surface is described by the formula below:

$$4(z-z_v)[F+\alpha_z(z-z_v)]=(r-b)^2$$

where:

(r,z)=the coordinates of a point on the reflector

F=the focal length of the unperturbed parabola $z_v$=the Z coordinate of the vertex of the shape b=is the offset of the parabola axis from the reflector axis $\alpha_z$=a dimensionless coefficient used to control the perturbation of the shape.

A dielectric rod 7 is integrated with the plug which fills the hole 5 in the sub-reflector. The dielectric rod improves the frequency bandwidth of the radiation patterns. For this application, a radome 8 was required.

Figure 7:
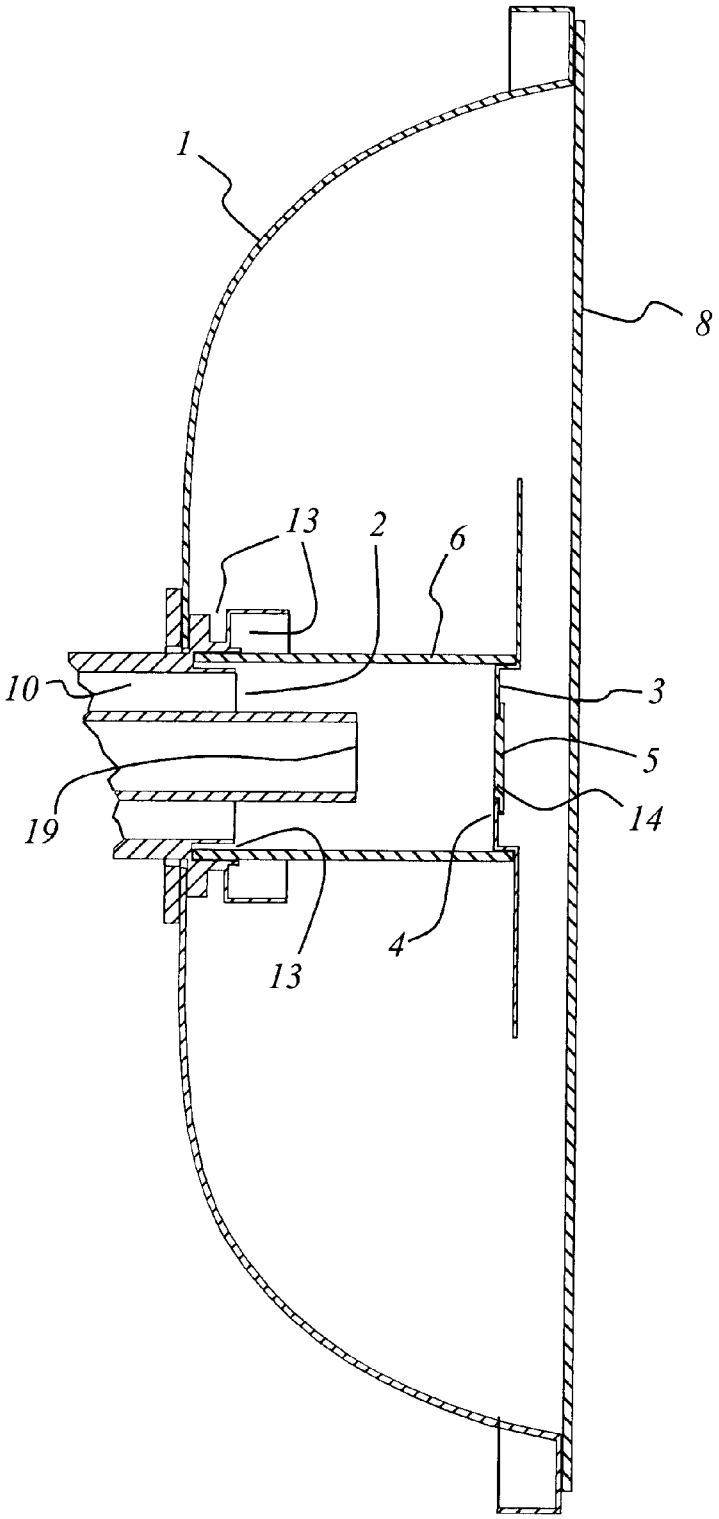
FIG. 7 is an axial cross-sectional drawing of a rotationally symmetric example of an antenna of the invention which was built for a repeater application.

FIG. 7 illustrates a rotationally symmetric embodiment of the invention. This antenna has an aperture diameter of approximately 4.5 wavelengths. It was designed for repeater applications and operates over a 7.6% frequency band. The requirements for this antenna were strict control of the side lobes in the back hemisphere and, in particular, in the region near 90 degrees from the main beam.

The measured aperture efficiencies were greater than 54.8%. The side lobes between 80 degrees and 100 degrees are predicted to be less than −45 dBp in the E plane and less than −38 dBp in the H plane. The predicted front to back ratio is greater than 47 dB. The shape of the main reflector 1 has been greatly perturbed from parabolic. The equation that describes the shape is:

$$4(z-z_v)[F+\alpha_z(z-z_v)]=(r-b)^2\{1+\alpha_r[(r-b)/F]^2\}$$

where $r,z,z_v,b,\alpha_z$ are as defined above and $\alpha_r$ is a dimensionless coefficient used to control a second method of perturbing the shape.

One of the design goals (for cost reasons) was to minimize the diameter of the feed. This was achieved by using a coaxial waveguide 10 operating with the $TE_{11}$ mode rather than the more common circular waveguide. The feed aperture is very elaborate as it includes 3 chokes and the termination of the cut-off circular waveguide 19. The dielectric support for the sub-reflector 6 is a piece of PVC tubing. It is glued to the feed aperture and the sub-reflector.

Another of the design goals (again for cost reasons) was to simplify the shape of the sub-reflector. In this case it is a spun aluminum piece whose thickness is almost constant. There is little shaping to either the inner surface 4 or outer surface 3 of the sub-reflector. The hole in the sub-reflector 5 is plugged with a polycarbonate piece 14. A thin flat radome 8 is affixed to the rim of the reflector.

Thus, there has been illustrated and described a unique and novel High Gain, Low Side Lobe Dual Reflector Microwave Antenna, and which thereby fulfills all of the objects and advantages which have been sought. It should be understood that many changes, modifications, variations and other uses and applications which will become apparent to those skilled in the art after considering the specification and the accompanying drawings. Therefore, any and all such changes, modifications, variations and other uses and applications which do not depart from the spirit and scope of the invention are deemed to be covered by the invention.

What is claimed is:

1. An antenna for transmission and reception of electromagnetic waves, the antenna comprising:

a main reflector having an outer surface;

a sub-reflector spaced from said main reflector and having an inner surface facing the outer surface of said main reflector and said sub-reflector having an outer surface facing away from the main reflector; and an opening in the sub-reflector allowing radiation to pass therethrough and thereby bypass the main reflector.

2. The antenna of claim 1 wherein said antenna further comprises:

a waveguide associated with said opening and which allows the radiation to pass through said opening while controlling the phase and amplitude of the radiation passing through the opening.

3. The antenna of claim 2 further characterized in that said waveguide is loaded with a dielectric material which reduces the effective path difference between the radiation passing through the opening and the radiation which is received at the main reflector.

4. The antenna of claim 3 further characterized in that said dielectric material extends outside the opening in the sub-reflector and forms a dielectric waveguide.

5. The antenna of claim 1 further characterized in that the outer surface of said sub-reflector is arranged to control the pattern of the radiation which can pass through the opening.

6. The antenna of claim 1 further characterized in that the outer surface of said sub-reflector has a shape which approximates that of a horn antenna which aids in the control of the radiation passing through said opening.

7. The antenna of claim 1 further characterized in that the feed aperture is shaped.

8. The antenna of claim 7 further characterized in that at least one choke is disposed at said feed aperture.

* * * * *